US005360049A

United States Patent [19]

Rowe

[11] Patent Number: 5,360,049

[45] Date of Patent: Nov. 1, 1994

[54] CORE BOX VENT CONSTRUCTION

[76] Inventor: Melvin L. Rowe, 9434 Lakewood, Grosse Ile, Mich. 48138

[21] Appl. No.: 1,700

[22] Filed: Jan. 7, 1993

[51] Int. Cl.[5] ..... B22C 7/06; B22C 9/12

[52] U.S. Cl. ..... 164/16; 164/234; 164/410

[58] Field of Search ..... 164/234, 410, 186, 200, 164/201, 202, 16

[56] References Cited

U.S. PATENT DOCUMENTS

| | | |
|---|---|---|
| 2,205,327 | 6/1940 | Williams . |
| 2,871,008 | 1/1959 | Spire . |
| 3,037,252 | 6/1962 | House et al. . |
| 3,572,421 | 3/1971 | Mezey et al. . |
| 3,751,271 | 8/1973 | Kimura et al. . |
| 3,943,009 | 3/1976 | Hipp . |
| 4,661,153 | 4/1987 | Sinha . |
| 4,844,425 | 7/1989 | Piras et al. . |

FOREIGN PATENT DOCUMENTS

| | | | |
|---|---|---|---|
| 55-73443 | 6/1980 | Japan | 164/410 |
| 55-147453 | 11/1980 | Japan | 164/410 |
| 58-47538 | 3/1983 | Japan | 164/410 |
| 60-92044 | 5/1985 | Japan | 164/200 |
| 146920 | 9/1962 | U.S.S.R. | 164/234 |

*Primary Examiner*—J. Reed Batten, Jr.

[57] ABSTRACT

The core box vent useful in core making, comprises a porous cylinder of sintered ceramic materials, the pores of such cylinder being less than will allow intrusion of the grain size of sand to be introduced to the core box. A method of making cores using the above vent comprises, first, providing mateable core box sections with blow tubes permitting introduction of an air fluidized sand mixture into the interior of such box sections and providing one or more ceramic core box vents in an exhaust side of the mating core box sections to permit egress of air used to fluidize the sand mixture the vents have a labyrinth of passages or pores smaller in diameter at least than the average grain size of the sand in the mixture sand and resin mixture is blown into the interior of the mated core box sections, with the resin being curable to polyurethane by chemical reaction. Next a catalyst curing gas is blown through the mixture via such blow tubes. Lastly, the mixture is purged with air.

3 Claims, 2 Drawing Sheets

CORE BOX VENT CONSTRUCTION

BACKGROUND OF THE INVENTION

1. Technical Field

This invention relates to the technology of making boxes for forming sand cores, and more particularly to means for venting such boxes without clogging during production use.

2. Discussion of the Prior Art

Core boxes are devices used to form sand cores useful in foundry practices such as casting of metals with internal cavities. The core boxes essentially are tooling with internal cavities contoured to produce the desired core shape. Sand, coated with resin, is blown into the cavities and then cured to produce the finished core. To assure complete filling of the cavity space and optimum hardness and density of the core, vents are required which allow air to escape from the cavities as the sand mix is blown thereinto.

Conventionally, these vents are of either a sheet steel plug construction, the face and sides of which have been cut or perforated, or a hollow steel plug embedded with a mesh screen in the face thereof. These vents are used in extremely large quantities during high-volume core making. During such core production, smaller particles of the resin coated sand are unwantedly blown through the vents, causing the resin to be deposited on its surface. The resin will build up until the vent becomes completely clogged, requiring undesirable cleaning or replacement. Productivity is adversely affected and frequency of cleaning is great.

In any modification of such vents, a designer must be concerned with related factors, such as: (i) the mold releasing properties of the vent structure, (ii) the ease of fabricating the core vent, (iii) the abrasion resistance and heat and chemical resistance of the vent structure, (iv) the opening area or opening rate of the vent to permit the passage of gases while restricting the passage of solid particles, and (v) the structural strength of the core vent to prevent deterioration on handling and reuse.

The prior art sheet metal vent of FIG. 1 is first stamped into a thimble shape 10 having corrugations 11 along the shallow skirt wall 12, and wavy slots 13 cut or crimped into the generally flat face 14 of the vent. The width of the slots is preferably about 0.01–0.02 inch (less than 0.25 mm). Such vent must be expensively nickel plated to provide corrosion resistance and to impart a release capability from a sand mold. The strength of the face material (sheet metal) allows for the slots to be placed close together; moreover, the slots allow for increased opening area or rate (as much as 40% if the slots are closely intertwined). Due to the inherent width of mechanically formed slots, some small particles of resin coated sand will be blown through the vent slots causing resin to be left deposited on the surface of the vent. Resin and sand will eventually build up, completely plugging the vent. This may occur within a frequency of 2–4 hours of use.

The face 14 (head) and skirt 12 (body) of the vent are commercially formed independently and joined by brazing or spot welding. This adds to the expense of the vent fabrication. Earlier versions of the sheet metal vents have used parallel slits 15 which necessitate greater spacing 16 reducing the opening area significantly (compare center section of FIG. 2 with left-hand section of FIG. 2). The parallel slits 15 more readily clog. A more economical vent is that as shown in the right-hand section of FIG. 2; this vent incorporates a mesh screen 17 across the end of a sleeve, the screen providing greater opening area than the parallel slit type, and not only permits some sand/resin to pass through, but is significantly more fragile and is subject to deformation upon cleaning of the mesh.

Therefore, it remains a problem for the foundry industry to find a core vent construction that is less cloggable than current designs and yet acceptably meets such other criteria for a good core vent.

SUMMARY OF THE INVENTION

In a first aspect, the invention is a novel core box vent useful in core making, comprising a porous cylinder of sintered ceramic, the pores of such cylinder being less than that which allows intrusion of the sand grains to be introduced to the core box.

In a second aspect, the invention is a method of making cores using the above vent, comprising: providing mateable core box sections with blow tubes permitting introduction of an air fluidized sand mixture into the interior of the box sections and with one or more ceramic core box vents in an exhaust side of the mating core box sections to permit egress of air used to fluidize the sand mixture, the vents having a labyrinth of passages or pores smaller in diameter than will allow intrusion of the grain size of the sand in the mixture; blowing a sand and resin mixture into the interior of the mated core box sections, such resin being curable to polyurethane plastic by chemical reaction; blowing a catalyst curing gas through the mixture via said blow tubes; and purging the mixture with air to remove excess triethylamine gas.

Figure 1:
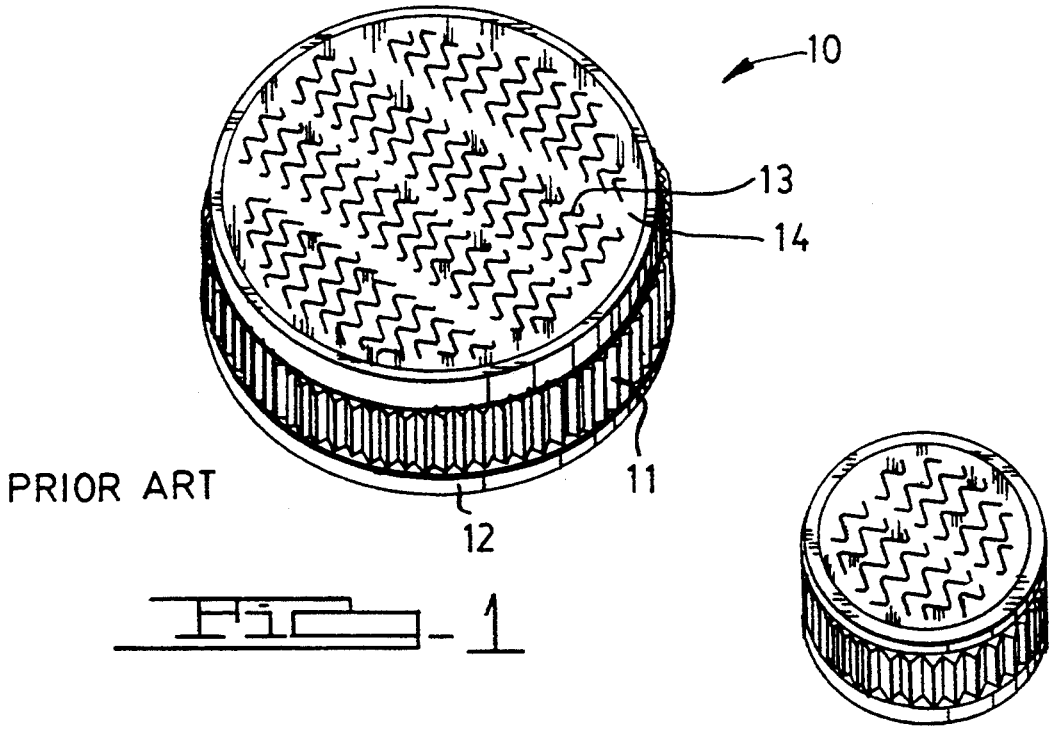
FIG. 1 is a perspective view of one type of prior art vent using sheet metal.
Figure 2:
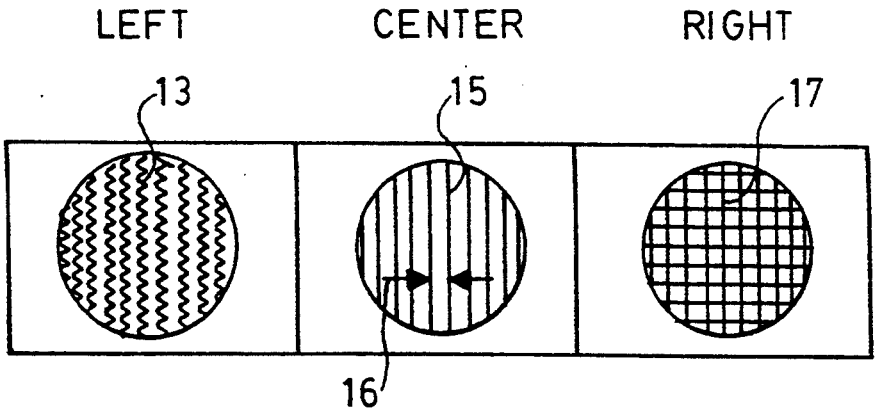
FIG. 2 PRIOR ART
FIG. 2 is a composite diagram comparing vent face configurations used by the prior art.
Figures 3, 4:
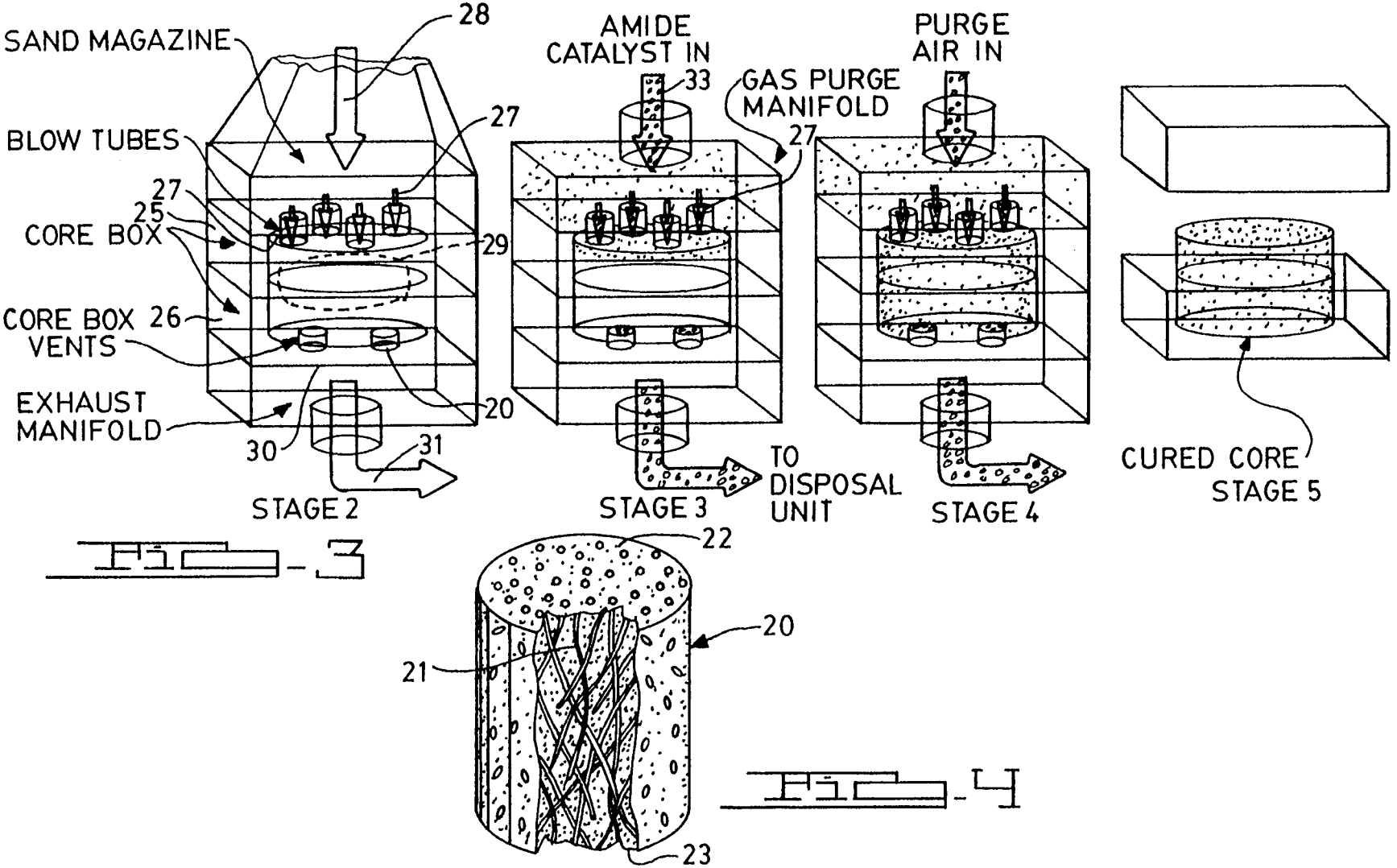
FIG. 3 is a schematic perspective flow diagram of the method of making cores embodying this invention.
FIG. 4 is an enlarged perspective view of the core vent of this invention, partially broken away.

The core box vent of this invention is a ceramic body 20 (as shown in FIG. 4) comprised of sintered ceramic materials. The ceramic is selected from the group consisting of $Al_2O_3$ and $SiO_2$. The ceramic is fabricated to have a labyrinth of pores or passages 21 interconnecting and providing a circuitous passage of gases from the porous entrance face 22 to the exit face 23. The pores or passages have a cross-sectional diameter that is less than will allow intrusion of the grain size of the sand introduced to the core box interior.

The vents, when used in the method depicted in FIG. 3, provide certain new advantages in core making, such as avoidance of having to remove the core box from production and clean/replace vents. This method comprises, in a first stage, forming mateable core box sections 25, 26 with blow tubes 27 permitting introduction of an air fluidized sand mixture 28 into the interior cavity 29 of the mating core box sections 25, 26, and with one or more ceramic core box vents 20 placed in an exhaust side 30 or manifold under the mated core box sections thereby to permit egress of the air 31 used to fluidize the sand mixture. The vents have a labyrinth of passages 21 or pores, smaller in diameter than will allow intrusion at the grain size of the sand mixture. The vents have a sufficient open area that permits ready passage of gases such as air and gas used in the core making process.

In stage two, the sand and resin mixture is blown through the blow tubes into the sand body in the core box section cavity; the resin is of the type curable to polyurethane plastic by a chemical reaction. The vents permit no sand grains with resin to pass through.

In stage three, a catalyst curing gas 33 is blown through the blow tubes 27 (the gas here being an amide) and exhausted through the vents 20 into the manifold. The amide causes the resin to set.

In stage four, the gas cured resin sand mixture is purged by forcing air into the sand core within the core box sections through the blow tubes again allowing the air to exit through the vents 20 without passage of any grains of sand.

In the last stage, the core box sections are separated and the cured core is removed.

I claim:

1. A core box vent construction for use in a core box that molds sand grains, comprising a porous cylinder of sintered ceramic material, selected from $Al_2O_3$ and $SiO_2$, the pores of such ceramic material providing the sole means for passage of material through the vent, said pores being circuitous, labyrinthium and having a dimension less than that which allows passage of said sand grains to be introduced to the core box.

2. The core box construction for molding resin laden particulate matter, comprising:

(a) mateable core box sections;

(b) blow tubes in one section permitting ingress of gasses and particulate matter; and (c) porous ceramic vents in the other section to permit egress of gasses only through said pores but having a pore size effective to prevent the egress of said resin laden particulate matter.

3. A method of making cores, comprising:

(a) forming mateable core box sections with blow tubes permitting introduction of an air fluidized sand mixture into the interior of the mating core box sections, and further forming one or more ceramic core box vents in the exhaust side of the mated core box section to permit egress of air used to fluidize the sand mixture, said vents having a labyrinth of passages or pores smaller in diameter than that which allows intrusion of the grain size of said sand mixture;

(b) blowing a sand and resin mixture through said blow tubes into said mated core box sections and prevented from exiting through said vents, said resin being curable to polyurethane by chemical reaction;

(c) forcing a catalyst curing gas through said blow tubes to cure said sand and resin mixture again without migration of any of said sand through said vents; and (d) purging said core box sections with air introduced through said blow tubes and exiting from said core sand mixture via said vents.

* * * * *